US011581651B2

(12) United States Patent
Yin et al.

(10) Patent No.: US 11,581,651 B2
(45) Date of Patent: Feb. 14, 2023

(54) MICROSTRIP ANTENNA AND TELEVISION

(71) Applicant: SHENZHEN TCL NEW TECHNOLOGY CO., LTD., Guangdong (CN)

(72) Inventors: Liuzhong Yin, Guangdong (CN); Kangqing Guo, Guangdong (CN); Renli Xie, Guangdong (CN); Zitong Wang, Guangdong (CN); Fujun Yang, Guangdong (CN)

(73) Assignee: Shenzhen TCL New Technology Co., Ltd., Shenzhen (CN)

( * ) Notice: Subject to any disclaimer, the term of this patent is extended or adjusted under 35 U.S.C. 154(b) by 65 days.

(21) Appl. No.: 17/267,037

(22) PCT Filed: Oct. 31, 2019

(86) PCT No.: PCT/CN2019/114820
§ 371 (c)(1),
(2) Date: Feb. 9, 2021

(87) PCT Pub. No.: WO2020/098508
PCT Pub. Date: May 22, 2020

(65) Prior Publication Data

US 2021/0305698 A1 Sep. 30, 2021

(30) Foreign Application Priority Data

Nov. 14, 2018 (CN) ..... 201811356196.2

(51) Int. Cl.
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
CPC ..... H01Q 1/22; H01Q 1/48; H01Q 9/045; H01Q 9/0414; H01Q 9/0421
See application file for complete search history.

(56) References Cited

U.S. PATENT DOCUMENTS 4,401,988 A * 8/1983 Kaloi ..... H01Q 19/005 343/700 MS
8,847,842 B2 * 9/2014 Zeiger ..... H01Q 1/48 343/700 MS (Continued)

FOREIGN PATENT DOCUMENTS

CN 101257147 A 9/2008
CN 101533939 A 9/2009

(Continued)

OTHER PUBLICATIONS

First Office Action in counterpart Chinese Application No. 201811356196.2, dated Mar. 3, 2020.

(Continued)

*Primary Examiner* — Tung X Le
(74) *Attorney, Agent, or Firm* — Nathan & Associates; Menachem Nathan

(57) ABSTRACT

Disclosed are a microstrip antenna and a television. The microstrip antenna comprises a substrate, an excitation layer and a grounding layer which are provided on the substrate, and a feed unit and a coupling structure which are provided in the excitation layer. The feed unit is electrically connected to the excitation layer. A coupling layer and the excitation layer are electrically connected to the grounding layer. The coupling structure comprises the coupling layer and a dielectric layer. The dielectric layer is located between the excitation layer and the coupling layer. The coupling layer and the excitation layer are electrically connected to the grounding layer.

19 Claims, 4 Drawing Sheets

(56) References Cited

U.S. PATENT DOCUMENTS

| | | | | |
|---|---|---|---|---|
| 2009/0058731 | A1* | 3/2009 | Geary | H01Q 5/378 343/700 MS |
| 2010/0149060 | A1 | 6/2010 | Lin et al. | |
| 2015/0236415 | A1* | 8/2015 | Bily | H01Q 3/34 342/372 |
| 2018/0166780 | A1 | 6/2018 | Bily et al. | |
| 2019/0013580 | A1* | 1/2019 | Vigano | H01Q 3/2658 |
| 2020/0021008 | A1* | 1/2020 | Yong | H01Q 21/005 |

FOREIGN PATENT DOCUMENTS

| | | | |
|---|---|---|---|
| CN | 103094681 | A | 5/2013 |
| CN | 104124519 | A | 10/2014 |
| CN | 204167474 | U | 2/2015 |
| CN | 104505582 | A | 4/2015 |
| CN | 105186109 | A | 12/2015 |
| CN | 105186130 | A | 12/2015 |
| CN | 205039246 | U | 2/2016 |
| CN | 105552550 | A | 5/2016 |
| CN | 105789870 | A | 7/2016 |
| CN | 106067598 | A | 11/2016 |
| CN | 106252858 | A | 12/2016 |
| CN | 207038705 | U | 2/2018 |
| CN | 107819203 | A | 3/2018 |
| CN | 108134196 | A | 6/2018 |
| CN | 207441964 | U | 6/2018 |
| CN | 207587965 | U | 7/2018 |
| CN | 207835638 | U | 9/2018 |
| CN | 207967301 | U | 10/2018 |
| CN | 109449573 | A | 3/2019 |
| KR | 20080070607 | A | 7/2008 |

OTHER PUBLICATIONS

International Search Report in corresponding PCT Application No. PCT/CN2019/114820, dated Jan. 8, 2020.

Written Opinion of the International Searching Authority in corresponding PCT Application No. PCT/CN2019/114820, dated Jan. 8, 2020.

* cited by examiner

MICROSTRIP ANTENNA AND TELEVISION

CROSS REFERENCE TO RELATED APPLICATIONS

This application is the National Stage of International Application No. PCT/CN2019/114820, filed on Oct. 31, 2019, which claims the benefit of Chinese Patent Application No. 201811356196.2, filed on Nov. 14, 2018 and entitled "Microstrip Antenna and Television", the entirety of which is hereby incorporated herein by reference.

TECHNICAL FIELD

This application relates to the field of wire technology, in particular to a microstrip antenna and a television.

BACKGROUND

With the development of wireless communication technology, the demand for home communication products is increasing. As the core component of signal transmission and reception, antennas are widely used in home communication products. The microstrip antenna has the advantages of miniaturization, easy integration, and good directivity, so it has broad application prospects.

The general microstrip antenna is on a thin dielectric substrate, one side is attached with a thin metal layer as a grounding plate, and the other side is made into a metal patch of a certain shape by a photolithography method, which is a planar antenna with microstrip line or coaxial probe fed to the patch. The microstrip antenna has a planar structure and is easy to integrate with other circuits. However, the application of the microstrip antenna in the field of smart TVs currently mainly suffers from the problem of radiation direction, which makes the smart TV have low forward gain and small bandwidth range.

SUMMARY

The main object of this application is to provide a microstrip antenna, which aims to provide a microstrip antenna that is miniaturized, has higher gain, and can increase bandwidth.

To achieve the above object, this application provides a microstrip antenna, including:

a substrate, including a mounting surface and a grounding surface arranged oppositely;

an excitation layer, provided on the mounting surface of the substrate;

a grounding layer, provided on the grounding surface of the substrate;

a power feeder, provided on a side of the grounding layer facing away from the substrate, and penetrated through the substrate to be electrically connected to the excitation layer; and a coupling structure, provided on a side of the excitation layer facing away from the mounting surface of the substrate, and including a coupling layer and a dielectric layer, the dielectric layer being located between the excitation layer and the coupling layer, the coupling layer and the excitation layer being electrically connected to the grounding layer.

In an embodiment of this application, the substrate defines a metalized via, the grounding layer defines a hollow hole corresponding to the metalized via, and the excitation layer is electrically connected to the power feeder through the metalized via and the hollow hole.

In an embodiment of this application, the metalized via is provided with solidified metal.

In an embodiment of this application, the power feeder includes an inner conductor, a feeding point corresponding to the metalized via is provided in the hollow hole, and the excitation layer is electrically connected to the inner conductor through the metalized via and the feeding point.

In an embodiment of this application, the microstrip antenna is fed via a coaxial line, and the power feeder further includes an outer conductor and an insulator filling between the inner conductor and the outer conductor.

In an embodiment of this application, the substrate defines a metal through hole spaced apart from the metalized via, the dielectric layer defines a via corresponding to the metal through hole, the excitation layer is electrically connected to the grounding layer through the metal through hole, and the coupling layer is electrically connected to the grounding layer through the metal through hole and the via.

In an embodiment of this application, multiple metal through holes and multiple vias are defined, the multiple metal through holes are arranged at even intervals along an edge of the substrate, and the multiple vias are arranged at even intervals along an edge of the dielectric layer.

In an embodiment of this application, the metal through hole and the via are both circular holes.

In an embodiment of this application, a diameter of the metal through hole and a diameter of the via are both 0.15 mm.

In an embodiment of this application, a distance between a center of the metal through hole and a boundary of the substrate and a distance between the center of the metal through hole and a boundary of the dielectric layer are both 0.5 mm;

and/or, a distance between a center of the via and the boundary of the substrate and a distance between the center of the via and the boundary of the dielectric layer are both 0.5 mm.

In an embodiment of this application, the substrate is a double-layer circuit board.

In an embodiment of this application, a thickness of the substrate is 1.6 mm, and a thickness of the dielectric layer is 0.4 mm.

In an embodiment of this application, the substrate and the dielectric layer are made of epoxy resin.

In an embodiment of this application, a resonant frequency range of the microstrip antenna is 2.39 GHz to 2.50 GHz;

and/or, a standing wave ratio of the microstrip antenna is less than 2.

In an embodiment of this application, the microstrip antenna has a rectangular shape.

In an embodiment of this application, a length of the grounding layer is the same as a length of the coupling layer, and a width of the grounding layer is the same as a width of the coupling layer;

and/or, a width of the excitation layer is smaller than the width of the grounding layer, and the width of the excitation layer is also smaller than the width of the coupling layer.

In an embodiment of this application, a length of the microstrip antenna is 27.9 mm and a width of the microstrip antenna is 16.1 mm.

In an embodiment of this application, a length of the grounding layer and a length of the coupling layer are both 26.8 mm, and a width of the grounding layer and a width of the coupling layer are both 15.3 mm.

In an embodiment of this application, a width of the excitation layer is 0.7 mm smaller than the width of the grounding layer;

and/or, the width of the excitation layer is 0.7 mm smaller than the width of the coupling layer.

In addition, this application further provides a television mounted with a microstrip antenna, where the microstrip antenna includes:

a substrate, including a mounting surface and a grounding surface arranged oppositely;

an excitation layer, provided on the mounting surface of the substrate;

a grounding layer, provided on the grounding surface of the substrate;

a power feeder, provided on a side of the grounding layer facing away from the substrate, and penetrated through the substrate to be electrically connected to the excitation layer; and a coupling structure, provided on a side of the excitation layer facing away from the mounting surface of the substrate, and including a coupling layer and a dielectric layer, the dielectric layer being located between the excitation layer and the coupling layer, the coupling layer and the excitation layer being electrically connected to the grounding layer.

In the technical solution provided in this application, three metal layers of a grounding layer, an excitation layer, and a coupling layer are provided, and the coupling layer and the excitation layer are both electrically connected to the grounding layer to realize a short circuit design, which reduces the antenna size, and has simple manufacturing process and low cost. And horizontal omnidirectional radiation may be realized, so as to improve the radiation pattern, and facilitate improving the forward gain of the TV. The excitation layer is electrically connected to the power feeder, and the signal is fed into the microstrip antenna therefrom. The back feed method is adopted to reduce the feeding layer and reduce the cost. A coupling layer is added on the basis of the excitation layer, so that double resonance is realized through the excitation layer and the coupling layer, and the bandwidth is increased.

BRIEF DESCRIPTION OF THE DRAWINGS

In order to more clearly describe the technical solutions in the embodiments of this application or the prior art, the following will briefly introduce the drawings that need to be used in the description of the embodiments or the prior art. Obviously, the drawings in the following description are only some embodiments of this application. For those of ordinary skill in the art, without creative work, other drawings can be obtained according to the structures shown in these drawings.

Figure 1:
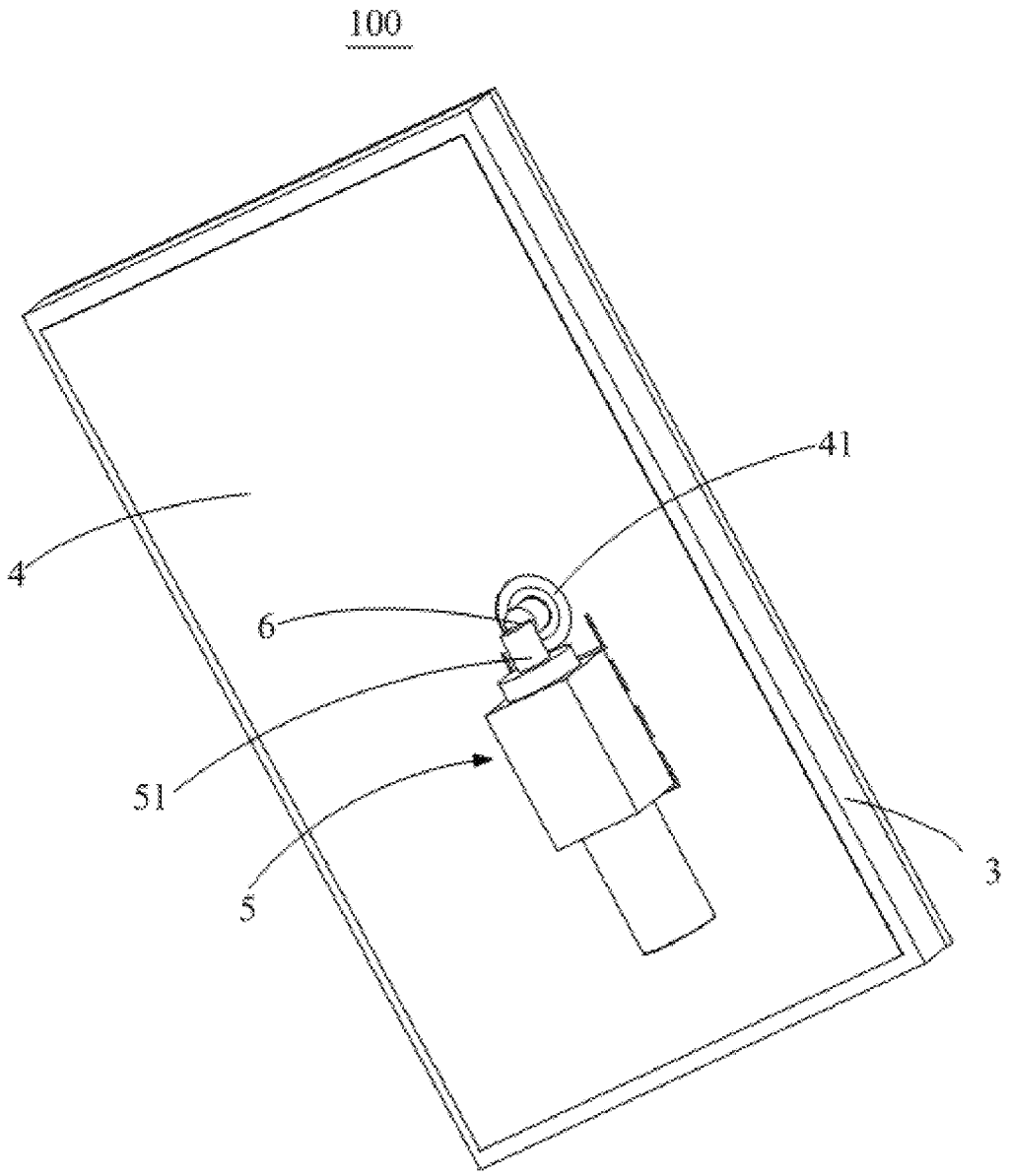
FIG. 1 is a schematic structural diagram of a microstrip antenna according to an embodiment of this application.
Figure 2:
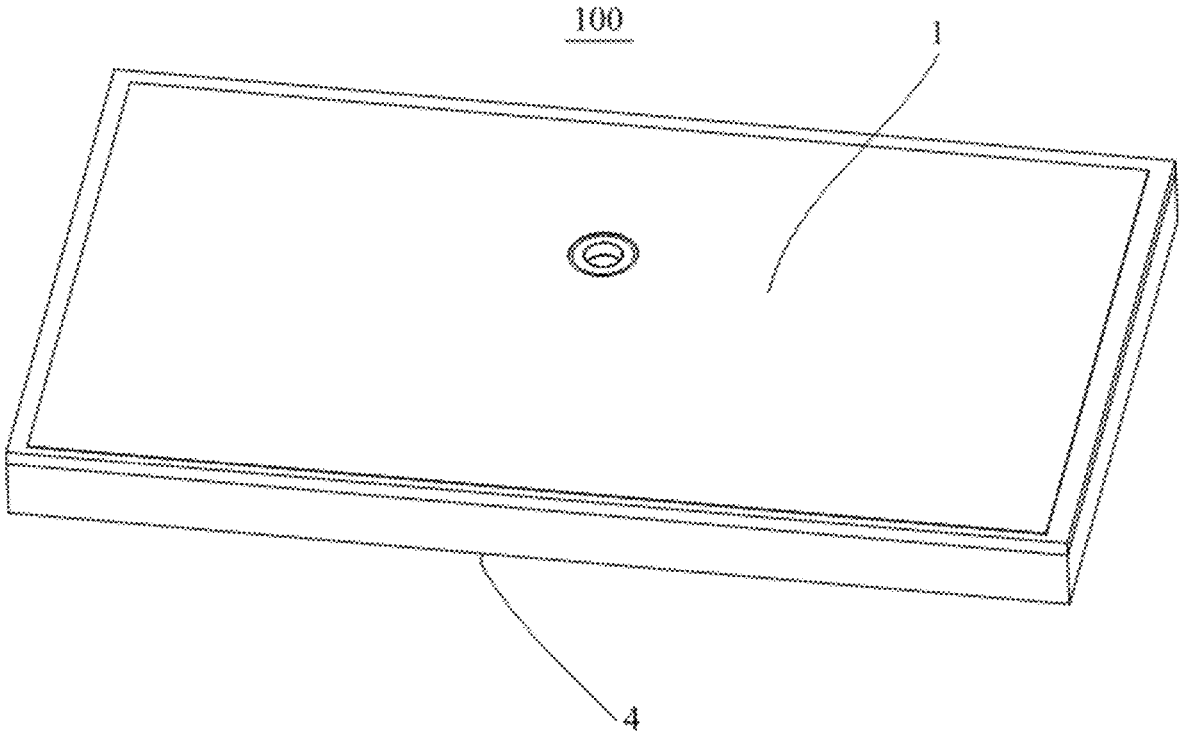
FIG. 2 is a schematic exploded structural diagram of the microstrip antenna in FIG. 1 from another perspective.

The realization of the purpose, functional characteristics, and advantages of this application will be further described in conjunction with the embodiments and with reference to the accompanying drawings.

DETAILED DESCRIPTION OF THE EMBODIMENTS

The technical solutions in the embodiments of this application will be described clearly and completely in conjunction with the drawings in the embodiments of this application. Obviously, the described embodiments are only a part of the embodiments of this application, but not all the embodiments. Based on the embodiments in this application, all other embodiments obtained by those of ordinary skill in the art without creative work shall fall within the protection scope of this application.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In this application, unless otherwise clearly specified and limited, the terms "connected", "fixed", etc. should be understood in a broad sense. For example, "fixed" can be a fixed connection, a detachable connection, or a whole; it can be a mechanical connection or an electrical connection; it can be a direct connection or an indirect connection through an intermediate medium, and it can be the internal communication between two components or the interaction relationship between two components, unless specifically defined otherwise. For those of ordinary skill in the art, the specific meanings of the above-mentioned terms in this application can be understood according to specific circumstances.

In addition, the descriptions related to "first", "second", etc. in this application are for descriptive purposes only, and cannot be understood as indicating or implying their relative importance or implicitly indicating the number of indicated technical features. Thus, the features defined as "first" and "second" may include at least one of the features either explicitly or implicitly. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, nor within the scope of protection required by this application.

This application provides a microstrip antenna 100.

Referring to FIGS. 1 to 4, according to an embodiment of this application, the microstrip antenna 100 includes a substrate 3, and the substrate 3 includes a mounting surface 33 and a grounding surface 34 disposed oppositely. The microstrip antenna 100 further includes an excitation layer 2, a grounding layer 4, a power feeder 5 and a coupling structure 1. The excitation layer 2 is provided on the mounting surface 33 of the substrate 3. The grounding layer 4 is provided on the grounding surface 34 of the substrate 3. The power feeder 5 is provided on a side of the grounding layer 4 facing away from the substrate 3, and the power feeder 5 is penetrated through the substrate 3 to be electrically connected to the excitation layer 2. The coupling structure 1 is provided on a side of the excitation layer 2 facing away from the mounting surface 33 of the substrate 3, and the coupling structure 1 includes a coupling layer 11 and a dielectric layer 12. The dielectric layer 12 is located between the excitation layer 2 and the coupling layer 11, and the coupling layer 11 and the excitation layer 2 are electrically connected to the grounding layer 4.

Specifically, the substrate 3 is a double-layer PCB (Printed Circuit Board), and the double-layer circuit board not only facilitates impedance matching of the microstrip antenna 100, but also facilitates the design of the feeding structure. In addition, the material selection of the substrate 3 will affect the performance of the microstrip antenna 100, for example, the gain and volume of the microstrip antenna 100, and the thickness of the substrate 3 will also affect the volume and weight of the microstrip antenna 100. In this embodiment, the substrate 3 and the dielectric layer 12 may be FR4 epoxy resin, which not only has low cost, but also ensures that good antenna operating characteristics are maintained at different operating frequencies. Optionally, the thickness of the substrate 3 is 1.6 mm, and the thickness of the dielectric layer is 0.4 mm.

In the technical solution provided in this application, three metal layers of a grounding layer 4, an excitation layer 2, and a coupling layer 11 are provided, and the coupling layer 11 and the excitation layer 2 are both electrically connected to the grounding layer 4 to realize a short circuit design, which reduces the antenna size, and has simple manufacturing process and low cost. And horizontal omnidirectional radiation may be realized, so as to improve the radiation pattern, and facilitate improving the forward gain of the TV. The excitation layer 2 is electrically connected to the power feeder 5, and the signal is fed into the microstrip antenna 100 therefrom. The back feed method is adopted to reduce the feeding layer and reduce the cost. A coupling layer 11 is added on the basis of the excitation layer 2, so that double resonance is realized through the excitation layer 2 and the coupling layer 11, and the bandwidth is increased.

Optionally, the shape of the microstrip antenna 100 may affect impedance matching, directivity function, etc., thereby affecting the radiation efficiency of the microstrip antenna 100. In this embodiment, the microstrip antenna 100 has a rectangular shape. In addition, the length and width of the microstrip antenna 100 will directly affect the volume of the antenna. In this embodiment, the length of the microstrip antenna 100 is 27.9 mm and the width of the microstrip antenna 100 is 16.1 mm, which is small in size, saves space, and is convenient for assembling the TV.

Figure 3:
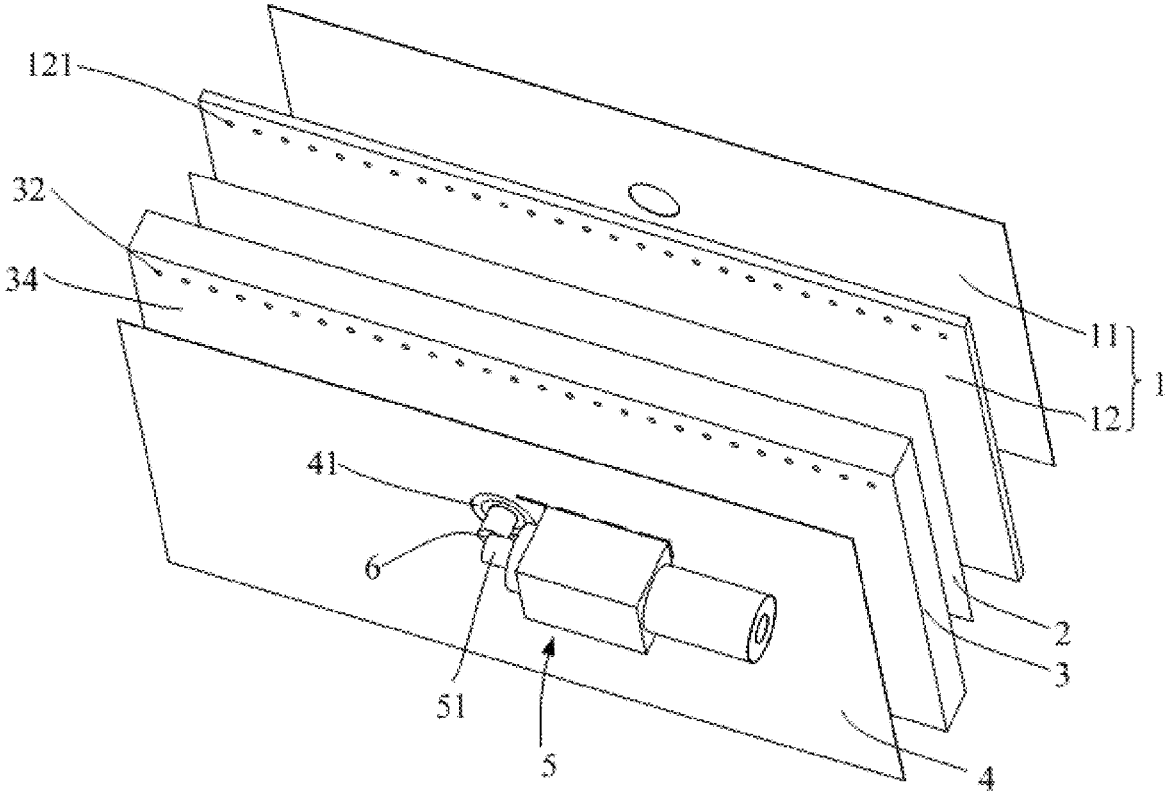
FIG. 3 is a schematic exploded structural diagram of the microstrip antenna in FIG. 1.
Figure 4:
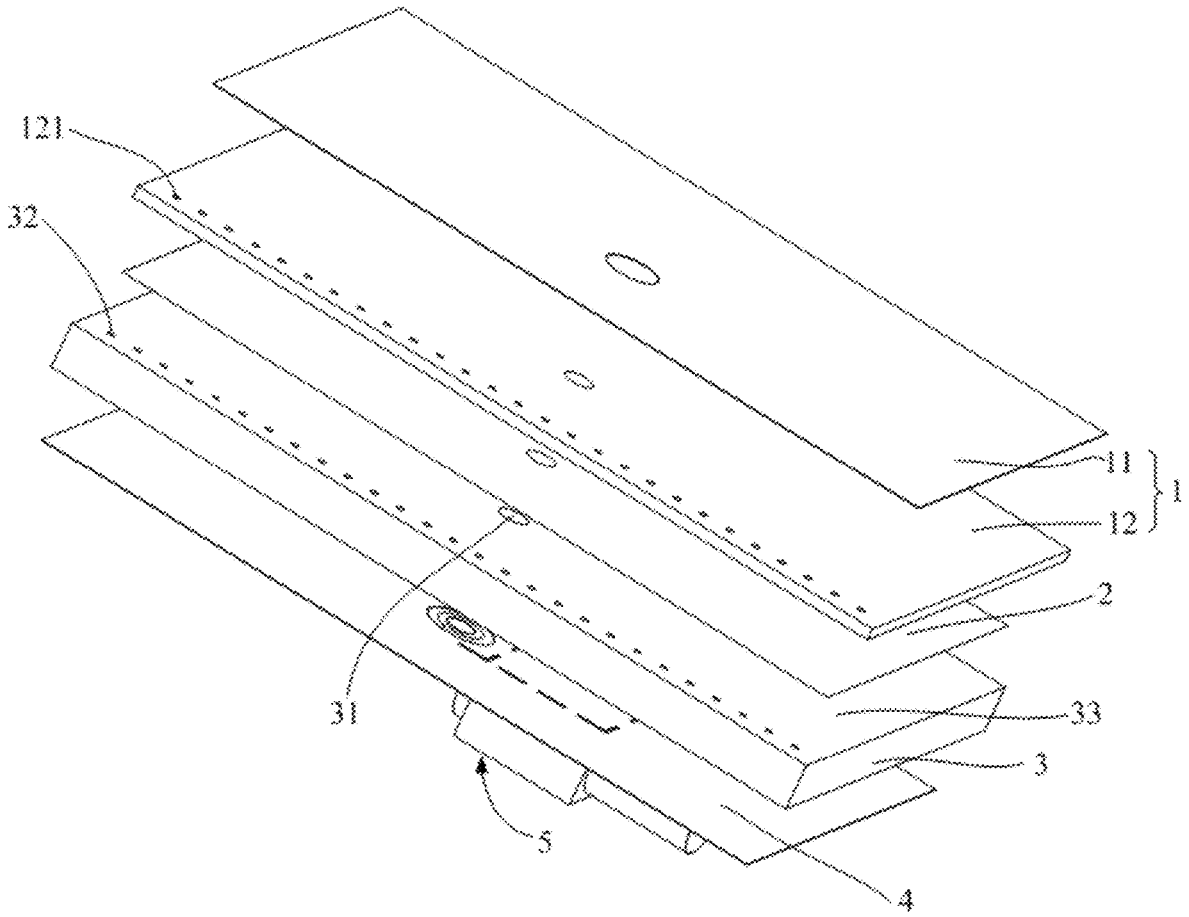
FIG. 4 is a schematic diagram of an exploded structure of the microstrip antenna in FIG. 1 from another perspective.

Referring to FIGS. 3 and 4, the substrate 3 defines a metalized via 31, the grounding layer 4 defines a hollow hole 41 corresponding to the metalized via 31, and the excitation layer 2 is electrically connected to the power feeder 5 through the metalized via 31 and the hollow hole 41.

The metalized via refers to a via with solidified metal inside, so that the via is electrically conductive. A hole may be drilled on the substrate 3, and then liquid metal (such as copper) may be injected into the hole and solidified to form a metalized via. In this embodiment, the excitation layer is electrically connected to the power feeder 5 through the metalized via 31 and the hollow hole 41 to realize signal transmission.

Please continue to refer to FIG. 3, the power feeder 5 includes an inner conductor 51. A feeding point 6 corresponding to the metalized via 31 is provided in the hollow hole 41, and the excitation layer 2 is electrically connected to the inner conductor 51 through the metalized via 31 and the feeding point 6.

Power feed of the antenna is to feed the antenna frequency signal. In this embodiment, a coaxial line power feed is adopted. The inner conductor 51, the outer conductor (not shown), and the insulator (not shown) filled between the inner conductor 51 and the outer conductor are generally coaxial. In this embodiment, the power feeder 5 is electrically connected to the excitation layer 2 through the feeding point 6 and the metalized via 31 to realize signal transmission.

Referring to FIGS. 3 and 4, the substrate 3 defines a metal through hole 32 spaced apart from the metalized via 31. The dielectric layer 12 defines a via 121 corresponding to the metal through hole 32. The excitation layer 2 is electrically connected to the grounding layer 4 through the metal through hole 32. The coupling layer 11 is electrically connected to the grounding layer 4 through the metal through hole 32 and the via 121.

In this embodiment, the excitation layer 2 is short-circuited with the grounding layer 4 through the metal through hole 32, and the coupling layer 11 is short-circuited with the grounding layer 4 through the metal through hole 32 and the via 121. The short-circuit structure realizes the gap radiation, which not only reduces the size of the antenna by about half, more importantly, improves the radiation pattern, which is conducive to the improvement of the TV forward gain.

Please continue to refer to FIGS. 3 and 4, multiple metal through holes 32 and multiple vias 121 are defined. The multiple metal through holes 32 are arranged at even intervals along an edge of the substrate 3, and the multiple vias 121 are arranged at even intervals along an edge of the dielectric layer 12.

The number of metalized vias for grounding will affect the radiation efficiency of the microstrip antenna 100. Generally speaking, the greater the number of metalized vias for grounding, the higher the radiation efficiency of the microstrip antenna 100. In this embodiment, the metal through holes 32 and the vias 121 are evenly spaced, and a reasonable density of the metalized vias is used as a short circuit to realize a miniaturized design of the antenna, and all radio frequency energy is radiated from the gap to improve the radiation efficiency.

Specifically, the number of the metal through holes 32 and the number of the via holes 121 are both 27. Both the metal through holes 32 and the via holes 121 are circular, which is convenient for processing. The diameters of both are 0.15 mm, and a distance between a center of the circle and a boundary of the substrate and a boundary of the dielectric layer 12 is 0.5 mm.

Optionally, the lengths of the grounding layer 4 and the coupling layer 11 are the same, and the widths of the grounding layer 4 and the coupling layer 11 are the same, and the width of the excitation layer 2 is smaller than the width of the grounding layer 4 and the coupling layer 11.

The size of the grounding layer 4, the coupling layer 11 and the excitation layer 2 will affect the volume of the entire microstrip antenna 100. In this embodiment, the lengths of the grounding layer 4 and the coupling layer 11 are the same, and the widths of the grounding layer 4 and the coupling layer 11 are the same, and the width of the excitation layer 2 is smaller than the width of the grounding layer 4 and the coupling layer 11. This arrangement facilitates signal coupling and realizes dual resonance, thereby expanding the bandwidth of the microstrip antenna 100. Specifically, the lengths of the grounding layer 4 and the coupling layer 11 are both 26.8 mm, and the widths of the grounding layer 4 and the coupling layer 11 are both 15.3 mm, and the width of the excitation layer 2 is 0.7 mm smaller than the width of the grounding layer 4 and the coupling layer 11.

Figure 5:
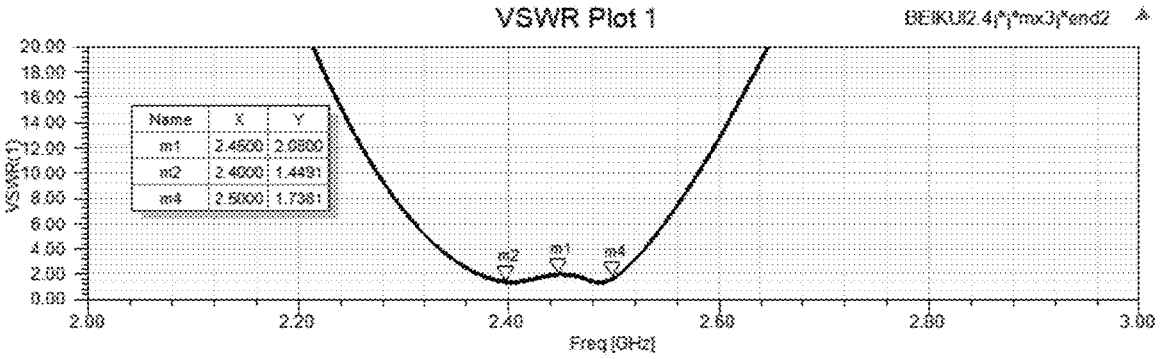
FIG. 5 is an S parameter curve diagram of the microstrip antenna in FIG. 1.
Figure 6:
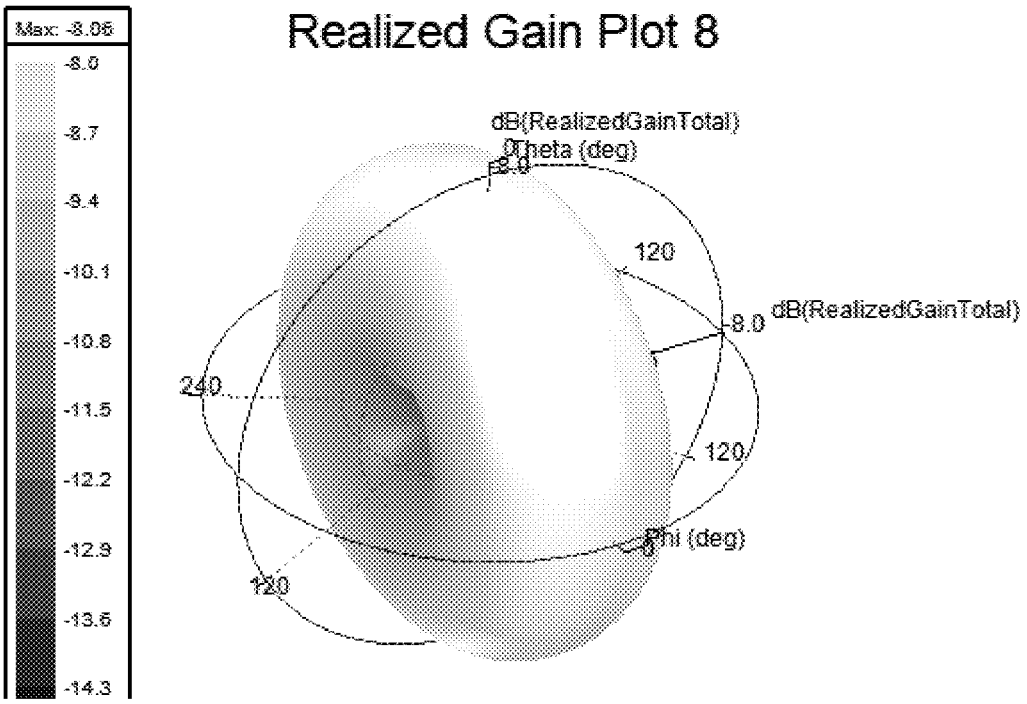
FIG. 6 is a simulated 3D radiation pattern of the microstrip antenna in FIG. 1.
Figure 7:
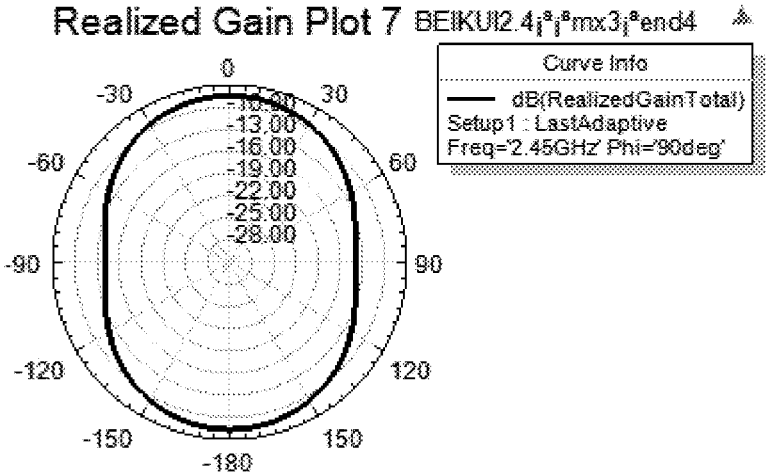
FIG. 7 is a cross-sectional view of a simulated 3D radiation pattern of the microstrip antenna in FIG. 1.

Referring to FIG. 5, FIG. 6 and FIG. 7, in this embodiment, the resonant frequency of the microstrip antenna 100 covers the frequency range of 2.39-2.50 GHz, and the standing wave ratio (VSWR) is less than 2, and the spatial omnidirectional radiation is achieved. In addition, because the microstrip antenna 100 is prominent in vertical polarization, it can be applied to scenarios that require high vertical polarization, such as wifi and Bluetooth.

This application further provides a television (not shown), which is mounted with a microstrip antenna 100. For the specific structure of the microstrip antenna 100, refer to the above-mentioned embodiments. Because this subject matter adopts all the technical solutions of all the above-mentioned embodiments, it has at least all the effects brought by the technical solutions of the above-mentioned embodiments, which will not be repeated here.

The above are only the optional embodiments of this application, and therefore do not limit the patent scope of this application. Under the conception of this application, any equivalent structural transformation made by using the content of the description and drawings of this application, or direct/indirect application in other related technical fields are all included in the patent protection scope of this application.

What is claimed is:

1. A microstrip antenna, comprising:

a substrate, comprising a mounting surface and a grounding surface arranged oppositely;

an excitation layer, provided on the mounting surface of the substrate;

a grounding layer, provided on the grounding surface of the substrate;

a power feeder, provided on a side of the grounding layer facing away from the substrate, and penetrated through the substrate to be electrically connected to the excitation layer; and a coupling structure, provided on a side of the excitation layer facing away from the mounting surface of the substrate, and comprising a coupling layer and a dielectric layer, the dielectric layer being located between the excitation layer and the coupling layer, the coupling layer and the excitation layer being electrically connected to the grounding layer, wherein the substrate defines a metalized via, the grounding layer defines a hollow hole corresponding to the metalized via, and the excitation layer is electrically connected to the power feeder through the metalized via and the hollow hole.

2. The microstrip antenna of claim 1, wherein the metalized via is provided with solidified metal.

3. The microstrip antenna of claim 1, wherein the power feeder comprises an inner conductor, a feeding point corresponding to the metalized via is provided in the hollow hole, and the excitation layer is electrically connected to the inner conductor through the metalized via and the feeding point.

4. The microstrip antenna of claim 3, wherein the microstrip antenna is fed via a coaxial line, and the power feeder further comprises an outer conductor and an insulator filling between the inner conductor and the outer conductor.

5. The microstrip antenna of claim 1, wherein the substrate defines a metal through hole spaced apart from the metalized via, the dielectric layer defines a via corresponding to the metal through hole, the excitation layer is electrically connected to the grounding layer through the metal through hole, and the coupling layer is electrically connected to the grounding layer through the metal through hole and the via.

6. The microstrip antenna of claim 5, wherein multiple metal through holes and multiple vias are defined, the multiple metal through holes are arranged at even intervals along an edge of the substrate, and the multiple vias are arranged at even intervals along an edge of the dielectric layer.

7. The microstrip antenna of claim 5, wherein the metal through hole and the via are both circular holes.

8. The microstrip antenna of claim 7, wherein a diameter of the metal through hole and a diameter of the via are both 0.15 mm.

9. The microstrip antenna of claim 7, wherein a distance between a center of the metal through hole and a boundary of the substrate and a distance between the center of the metal through hole and a boundary of the dielectric layer are both 0.5 mm;

and/or, a distance between a center of the via and the boundary of the substrate and a distance between the center of the via and the boundary of the dielectric layer are both 0.5 mm.

10. The microstrip antenna of claim 1, wherein the substrate is a double-layer circuit board.

11. The microstrip antenna of claim 1, wherein a thickness of the substrate is 1.6 mm, and a thickness of the dielectric layer is 0.4 mm.

12. The microstrip antenna of claim 1, wherein the substrate and the dielectric layer are made of epoxy resin.

13. The microstrip antenna of claim 1, wherein a resonant frequency range of the microstrip antenna is 2.39 GHz to 2.50 GHz;

and/or, a standing wave ratio of the microstrip antenna is less than 2.

14. The microstrip antenna of claim 1, wherein the microstrip antenna has a rectangular shape.

15. The microstrip antenna of claim 14, wherein a length of the grounding layer is the same as a length of the coupling layer, and a width of the grounding layer is the same as a width of the coupling layer;

and/or, a width of the excitation layer is smaller than the width of the grounding layer, and the width of the excitation layer is also smaller than the width of the coupling layer.

16. The microstrip antenna of claim 14, wherein a length of the microstrip antenna is 27.9 mm and a width of the microstrip antenna is 16.1 mm.

17. The microstrip antenna of claim 14, wherein a length of the grounding layer and a length of the coupling layer are both 26.8 mm, and a width of the grounding layer and a width of the coupling layer are both 15.3 mm.

18. The microstrip antenna of claim 17, wherein a width of the excitation layer is 0.7 mm smaller than the width of the grounding layer;

and/or, the width of the excitation layer is 0.7 mm smaller than the width of the coupling layer.

19. A television, mounted with a microstrip antenna, wherein the microstrip antenna comprises:

a substrate, comprising a mounting surface and a grounding surface arranged oppositely;

an excitation layer, provided on the mounting surface of the substrate;

a grounding layer, provided on the grounding surface of the substrate;

a power feeder, provided on a side of the grounding layer facing away from the substrate, and penetrated through the substrate to be electrically connected to the excitation layer; and a coupling structure, provided on a side of the excitation layer facing away from the mounting surface of the substrate, and comprising a coupling layer and a dielectric layer, the dielectric layer being located between the excitation layer and the coupling layer, the coupling layer and the excitation layer being electrically connected to the grounding layer, wherein the substrate defines a metalized via, the grounding layer defines a hollow hole corresponding to the metalized via, and the excitation layer is electrically connected to the power feeder through the metalized via and the hollow hole.

* * * * *